US005446927A

United States Patent [19]

Weldon

[11] Patent Number: 5,446,927

[45] Date of Patent: Sep. 5, 1995

[54] GARMENT WITH COEXTENSIVE SLIDING PERFORATED FABRIC LAYERS

[76] Inventor: Henry H. Weldon, 17207 N. 49th Ave., Glendale, Ariz. 85308

[21] Appl. No.: 951,181

[22] Filed: Sep. 24, 1992

[51] Int. Cl.[6] ..... A41D 13/00

[52] U.S. Cl. ..... 2/243.1; 2/115; 2/69; 2/1; 2/272

[58] Field of Search ..... 2/243 A, 243 B, 115, 2/DIG. 1, 4, 1, 51, 272, 272, 243.1, 69

[56] References Cited

U.S. PATENT DOCUMENTS 2,711,539 6/1955 Loscher ..... 2/DIG. 2
4,716,594 1/1988 Shannon ..... 2/4

*Primary Examiner*—Clifford D. Crowder
*Assistant Examiner*—Gloria Hale
*Attorney, Agent, or Firm*—Tod R. Nissle

[57] ABSTRACT

A garment for facilitating the evaporative cooling of the epidermis of a user while protecting the epidermis from sunlight includes two co-extensive layers of material having openings formed through each layer of material. The layers slide over one other to continually move openings in one layer out of registration with openings in another layer so that sunlight is prevented from penetrating the garment. The openings in the garment facilitate the flow of air through the garment to assist in the evaporative cooling of the user's epidermis.

13 Claims, 1 Drawing Sheet

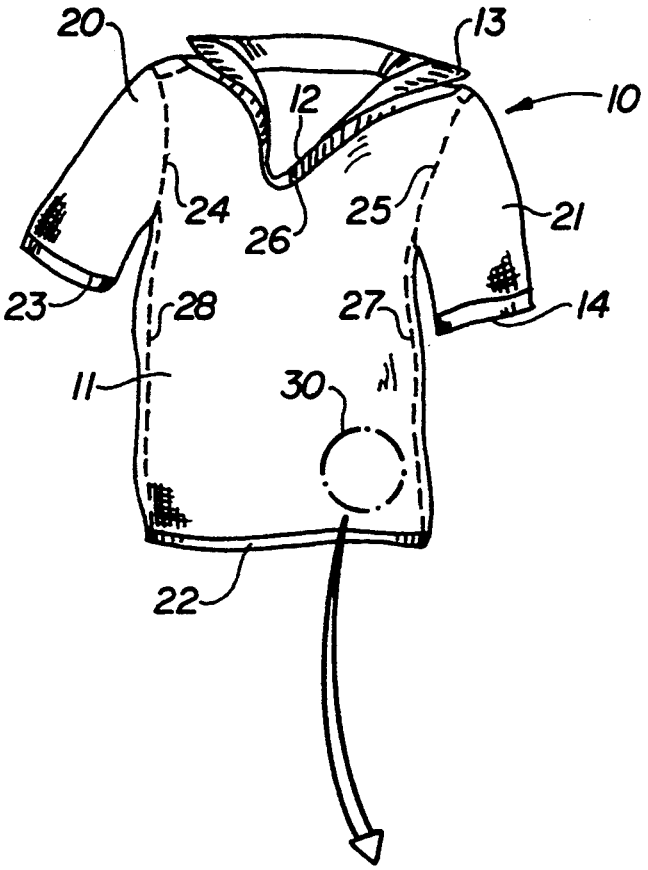
FIG. 1
FIG. 1A
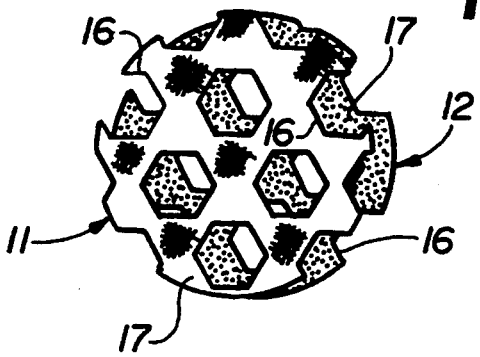
FIG. 3
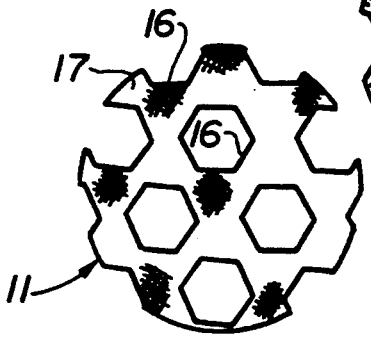
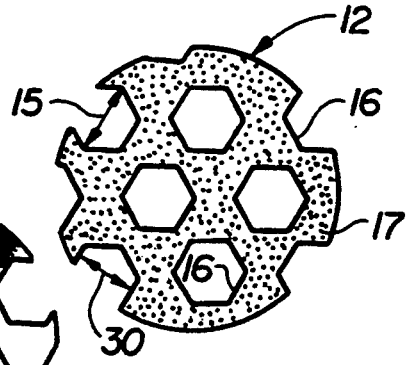
FIG. 2

GARMENT WITH COEXTENSIVE SLIDING PERFORATED FABRIC LAYERS

This invention relates to garments.

More particularly, the invention relates to garments which readily permit the evaporative cooling of the epidermis of a user while protecting the epidermis from sunlight.

In a further respect, the invention relates to garments which utilize two coextensive sliding layers of lightweight perforate pliable fabric to facilitate the evaporative cooling of the skin and prevent sunlight from contacting the skin.

Sunlight is a major cause of aging and skin cancer. Various garments can be worn to cover and protect the skin from sunlight. Such prior art garments, however, tend to interfere with the natural evaporative cooling of the skin, either because the garments block the flow of air over the skin or because the garments absorb perspiration produced by the body and do not permit the ready evaporation of the perspiration. Such prior art garments can also be rather bulky, interfering with normal movement of the body, and can be comparatively heavy, especially after the garments absorb perspiration or other moisture.

Accordingly, it would be highly desirable to provide a lightweight garment which would permit and promote the evaporative cooling of the epidermis of a user and would effectively protect the epidermis from sunlight.

Therefore, it is a principal object of the invention to provide an improved garment.

A further object of the invention is to provide an improved garment which, while permitting circulation of ambient air through the garment to the user's skin, blocks a large proportion of the sunlight traveling toward the user.

Another object of the invention is to provide an improved garment of the type described which is lightweight and does not interfere with the user's freedom of motion.

Still a further object of the invention is to provide an improved garment of the type described which efficiently promotes the evaporation of perspiration from the skin of the user and from the garment such that the garment does not adsorb perspiration.

These and other, further and more specific objects and advantages of the invention will be apparent to those skilled in the art from the following detailed description thereof, taken in conjunction with the drawings, in which:

FIG. 1 is a perspective view illustrating a shirt manufactured in accordance with the principles of the invention;

FIG. 1A is a partial section view of the shirt of FIG. 1 further illustrating the multilayer construction thereof;

FIG. 2 is a front view illustrating one of the layers of FIG. 1A; and,

FIG. 3 is a front view illustrating another of the layers of FIG. 1A.

Briefly, in accordance with my invention, I provide an article of clothing for shielding the epidermis of a user from sunlight and for promoting the evaporative cooling of the epidermis. The article of clothing includes at least two co-extensive layers of pliable woven fabric. Each layer of fabric has a plurality of openings formed therethrough; terminates and is fastened together with the other layer along a common edge; and, slidably contacts the other layer at points spaced apart from the common edge. The openings in each layer are shaped and dimensioned such that at any given time the majority of the openings in one of the layers are only in partial registration with the openings in the other of the layers; and, such that the sliding movement of the layers with respect to one another causes the position of the openings in one of the layers to continuously change with respect to the openings in the other of the layers. The fabric can be comprised of hydrophobic fibers of synthetic material and can be oleophilic.

In another embodiment of the invention, I provide an article of clothing for shielding the epidermis of a user from sunlight and for promoting the evaporative cooling of the epidermis. The article of clothing includes at least two co-extensive layers of pliable woven fabric. Each layer of fabric has a plurality of openings formed therethrough; terminates and is fastened together with the other layer along a common edge; and, slidably contacts the other layer at points spaced apart from the common edge. The openings in each of the layers comprise from nine percent to forty percent of the surface area of the layer. The openings can each have a width in the range of three sixty-fourths to sixteen sixty-fourths of an inch and the woven fabric intermediate and circumscribing the openings can have intersticial spaces with a width equal to or less than about one sixty-fourth of an inch.

In a further embodiment of the invention, I provide an article of clothing for shielding the epidermis of a user from sunlight and for promoting the evaporative cooling of the epidermis. The article of clothing includes at least two co-extensive layers of pliable woven fabric. Each layer of fabric has a plurality of openings formed therethrough; terminates and is fastened together with the other layer along a common edge; and, slidably contacts the other layer at points spaced apart from the common edge. The fabric is comprised of synthetic hydrophobic fibers, and absorbs perspiration by capillary action for evaporation into the air.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a shirt 10 constructed in accordance with the principles of the invention and including a right sleeve including an outer pliable fabric layer 20 and a co-extensive inner pliable fabric layer (not visible) connected to layer 20 along seam lines 23 and 24. The left sleeve of the shirt includes an outer pliable fabric layer 21 and a co-extensive inner pliable fabric layer (not visible) connected to layer 21 along seam lines 14 and 25. The front of the body of the shirt includes an outer pliable fabric layer 11 and a co-extensive inner pliable fabric layer 12 connected to layer 11 along seam lines 22, 24, 25; along the collar seam line(s) 26, and along seam lines 27 and 28 extending down the sides of the shirt. Collar 13 outwardly extends from seam line 26. The back of the body of the shirt can also, if desired, be comprised of a pair of coextensive perforate fabric layers. More than two perforate fabric layers can be utilized.

The fabric layer pairs in the sleeves and the front of the body of the shirt 10 are only connected to one another along the seam lines described so that the coextensive layer pairs are not attached to each other at points spaced away from the seams and are, therefore, free to move or slide over one another. When the shirt is worn on a user, the bodily movement of the user causes layer pairs in the sleeves and front of shirt to move and slide over one another. Each layer of fabric in the sleeves or in the body of the shirt includes a plurality of horizontal (in FIGS. 1A, 2, and 3) rows of hexagonal openings 16 of equal size formed in the fabric. The distance between each pair of openings 16 in a row is the same. The distance between each adjacent pair of rows of openings 16 is the same. Consequently, each layer of fabric in the shirt in FIG. 1 includes the same repeating pattern of rows of equally spaced hexagonal openings 16. As would be appreciated by those of skill in the art, the size and shape of each opening 16 in a fabric layer need not be the same, and, the distance between openings 16 can vary as desired. The repeating pattern of rows illustrated in FIGS. 1A to 3 facilitates the illustration of the invention.

While cotton and other natural fibers can be utilized in a garment constructed under the invention, hydrophobic and/or oleophilic synthetic materials like polyester fiber, glass fiber, nylon fiber, and rayon fiber are preferred in the practice of the invention. Such synthetic fibers do not absorb water or perspiration into the fibers as can cotton and other natural fibers. The synthetic fibers can also tend to attract water repellant oils from the skin. The use of hydrophobic fibers is important because the garment of the invention facilitates the evaporative cooling of the user's epidermis and body. While the garment "wicks" or absorbs by capillary action perspiration from the user, such perspiration preferably remains on and is stored between the outer surfaces of the fibers and threads and is not absorbed into the threads. The storage of perspiration on and between threads also facilitates the transmission of perspiration or other moisture from layer 12 to layer 11 for evaporation into the ambient air.

The width of each opening 16 can be in the range of three sixty-fourths to sixteen sixty-fourths of an inch, and is preferably in the range of three sixty-fourths to five sixty-fourths of an inch. As used herein, the term "width" indicates the average or mean width of an opening. For example, one-sixteenth of an inch is the width of a circular opening having a diameter of one-sixteenth of an inch; the width of a square opening having a side which is one-eighth of an inch long would be between one-eight inch and the length of a diagonal line extending from corner to corner through the center of the square; and, if the distance indicated by arrows 15 is six sixty-fourths of an inch and the distance indicated by arrows 30 is four sixty-fourths of an inch, then the width of each opening 16 is a value between four-sixty fourths of an inch and six-sixty-fourths of an inch. The woven fabric 17 intermediate each pair of openings 16 typically has intersticial openings formed in the woven fabric which each have a width of one-sixty fourth of an inch or less.

The openings 16 in one layer 11 of pliable fabric are shaped and dimensioned such that at any given instant the majority of or all of openings 16 in layer 11 each partially cover, align and register with an opening 16 in a second layer 12 of pliable fabric and partially cover a section of woven fabric 17 in layer 12. This feature of the invention is illustrated in FIG. 1A. FIG. 1A is an enlargement of the circular portion of the front of shirt 10 circumscribed by dashed lines 30 in FIG. 1. In FIG. 1A, the hexagonal openings in outer layer 11 each partially align and register with a hexagonal opening in inner layer 12. The hexagonal openings in outer layer 11 also each partially cover a portion of the fabric 17 in layer 12. Some of the sunlight passing through the hexagonal openings in layer 11 therefore strikes the fabric 17 in layer 12 and is prevented from contacting the skin of the user, while some of the sunlight passes through the hexagonal openings in layer 11 and also passes through an opening in layer 12 to contact the skin of the user. When the user moves his body, pliable layer 11 slides over layer 12, or vice versa, and the registration of openings in layer 11 with openings in layer 12 varies. When the registration of the openings in layer 11 with the openings in layer 12 varies, the portion of each opening in layer 11 which is over an opening in layer 12 varies.

In FIG. 1A, each opening in layer 11 covers or registers with a portion of an opening 16 in layer 12 which is of equivalent size to the portions of other openings 16 in layer 12 that are covered by or in registration with the other openings in layer 11. In shirts constructed in accordance with the invention, each opening 16 in layer 11 often is over a portion of an opening 16 in layer 12 which has a size or shape different than the portions of other openings 16 in layer 12 which are each covered by and in registration with an openings 16 in layer 11.

In order to insure that the fabric layers 11 and 12 used to form a portion of a garment effectively prevent a large portion of sunlight from contacting the skin of the user, the openings 16 formed in a layer 11 and 12 occupy nine to forty percent, preferably twelve to twenty percent, of the area encompassed by the peripheral edges of the fabric layer. By way of example, in a one-inch square piece of material from layer 11, the area occupied by the openings 16 is in the range of 0.1 square inches to 0.4 square inches, and the fabric 17 would occupy an area in the range of 0.9 to 0.6 square inches. If there are twenty openings 16 in the one inch square piece of material from layer 11, then each opening occupies an area of from 0.005 square inch to 0.02 square inch, and, if each opening 16 is circular the diameter (width) of each opening is in the range of 0.0399036 to 0.0798085 inch.

A warp knitted polyester tricot material having 100 to 200 denier yarn and a weight in the range of 1.2 to 2.6 ounces per square yard is presently preferred in the practice of the invention. Polyester and other synthetic materials are strong, lightweight, and facilitate the sliding of layers 11 and 12 over one another. In addition to the synthetic materials previously named, acetate, acrylic, triacetate, aramid, spandex fibers and other synthetic fibers can be utilized.

Having described my invention in such terms as to enable those skilled in art to understand, I claim:

1. An article of clothing for shielding the epidermis of a user from sunlight and for promoting the evaporative cooling of the epidermis, said article including at least two co-extensive layers of pliable woven fabric each (a) having a plurality of openings formed therethrough, (b) terminating with and fastened to the other layer along at least one common edge, and (c) slidably contacting the other layer at points spaced apart from said common edge, said openings in each of said layers being shaped and dimensioned such that at any given time at least the majority of said openings in said one of said layers are each partially over at least one of said openings in the other of said layers and are each partially over woven fabric in the other of said layers, and the sliding movement of said layers with respect to one another when said article is worn on the user causes the position of said openings in one of said layers to continuously change with respect to said openings in the other of said layers.

2. The clothing of claim 1 wherein said fabric is comprised of hydrophobic fibers of synthetic material.

3. The clothing of claim 2 wherein said fibers are oleophilic.

4. The article of clothing of claim 1 wherein said openings in each of said layers comprise from nine percent to forty percent of the surface area of said layer.

5. The article of clothing of claim 1 wherein said openings in each of said layers each have a width in the range of three sixty-fourths to sixteen sixty-fourths of an inch.

6. The article of clothing of claim 1 wherein the pliable woven fabric intermediate and circumscribing said openings has intersticial spaces with a width equal to or less than about one sixty-fourth of an inch.

7. The article of clothing of claim 5 wherein the pliable woven fabric intermediate and circumscribing said openings have intersticial spaces with a width equal to or less than about one sixty-fourth of an inch.

8. The article of clothing of claim 5 wherein said fabric is comprised of hydrophobic fibers of synthetic material.

9. The article of clothing of claim 5 wherein said fabric is comprised of oleophilic fibers of material.

10. The article of clothing of claim 8 wherein said fibers are oleophilic.

11. The article of clothing of claim 1 wherein said openings in each of said layers comprises from twelve to twenty percent of the surface area of said layer.

12. The article of clothing of claim 5 wherein said openings in each of said layers comprise from twelve to twenty percent of the surface area of said layer.

13. The article of clothing of claim 5 wherein said openings in each of said layers comprise from nine to forty percent of the surface area of said layer.

* * * * *